US006053781A

United States Patent [19]

Littleton

[11] Patent Number: 6,053,781

[45] Date of Patent: Apr. 25, 2000

[54] STEERING DEVICE FOR TROLLING MOTOR

[76] Inventor: Alan W. Littleton, Rte. 2 Box 3A, Downsville, La. 71234

[21] Appl. No.: 09/127,627

[22] Filed: Aug. 3, 1998

Related U.S. Application Data

[60] Provisional application No. 60/055,029, Aug. 8, 1997.

[51] Int. Cl.[7] ..... B63H 20/12

[52] U.S. Cl. ..... 440/62; 114/146; 440/63

[58] Field of Search ..... 440/6, 62, 63; 114/144 R, 146, 153

[56] References Cited

U.S. PATENT DOCUMENTS

| | | | |
|---|---|---|---|
| 2,878,768 | 3/1959 | Warblow . | |
| 2,912,877 | 11/1959 | Rohrer . | |
| 3,007,429 | 11/1961 | Sandman . | |
| 3,417,723 | 12/1968 | Akermanis . | |
| 3,559,612 | 2/1971 | Patterson . | |
| 3,580,212 | 5/1971 | Fortson | 440/7 |
| 3,641,962 | 2/1972 | Fowlkes et al. . | |
| 4,130,079 | 12/1978 | Rhorer et al. . | |
| 4,417,879 | 11/1983 | Kulischenko . | |
| 4,515,567 | 5/1985 | Wilson | 440/7 |
| 4,735,166 | 4/1988 | Dimalanta . | |
| 5,580,287 | 12/1996 | Wieringa | 440/6 |

FOREIGN PATENT DOCUMENTS

| | | |
|---|---|---|
| 1318074 | 1/1963 | France . |
| 304012 | 2/1918 | Germany . |
| 395077 | 5/1924 | Germany . |

*Primary Examiner*—Sherman Basinger
*Attorney, Agent, or Firm*—Richard C. Litman

[57] ABSTRACT

An auxiliary steering device for a trolling motor employing a steering block attached to the directional shaft of the trolling motor that is connected via a continuous cable to a pivoting stick positioned on the gunwale of a boat. The stick, working in combination with the directional shaft, provides remote steering of an outboard trolling motor. Remote steering enables the operator to be seated in a central location within the boat and to observe the condition of the water immediately in front of the bow. Such a remote steering arrangement also facilitates fishing and casting in all directions.

6 Claims, 2 Drawing Sheets

STEERING DEVICE FOR TROLLING MOTOR

CROSS-REFERENCE TO RELATED APPLICATION

This application claims the benefit of U.S. Provisional Patent Application Ser. No. 60/055,029, filed Aug. 8, 1997.

BACKGROUND OF THE INVENTION

1. Field of the Invention

The present invention relates to auxiliary steering devices for outboard motors and, more specifically, to a steering device for an outboard motor employing a mounting block attached to the directional control shaft of the trolling motor and connected via cables to a pivoting stick that is positioned on the gunwale of a boat.

2. Description of Related Art

Certain types of boats employed for fishing, especially fresh water fishing, are relatively long and provided with a relatively narrow beam to enable them to pass between obstructions. These boats are normally provided with a conventional outboard motor, which is attached to the transom, and normally steered by a projecting handle extending toward the bow. Such an arrangement prevents the operator of the boat from observing the condition of the water or obstructions immediately in front of the bow.

Further, it is preferable to fish from a seat centrally located within the boat, as such an arrangement facilitates fishing in all directions.

A number of devices for steering outboard motors from a position removed from the motor have been proposed, but in all cases they are quite complicated. The following patents illustrate previous steering devices: U.S. Pat. No. 2,878,768, issued to Warblow on Mar. 24, 1959; U.S. Pat. No. 2,912,877, issued to Rohrer on Nov. 17, 1959; U.S. Pat. No. 3,007,429, issued to Sandman on Nov. 7, 1961; U.S. Pat. No. 3,417,723, issued to Akermanis on Dec. 24, 1968; U.S. Pat. No. 3,559,612 issued to Patterson on Feb. 2, 1971; U.S. Pat. No. 3,641,962, issued to Fowlkes et al. on Feb. 15, 1972; U.S. Pat. No. 4,130,079, issued to Rhorer et al. on Dec. 19, 1978; U.S. Pat. No. 4,417,879, issued to Kulischenko on Nov. 29, 1983; French Patent Number 1,318,074 and German Patents 304,012 and 395,077.

U.S. Pat. No. 4,735,166, issued to Dimalanta on Apr. 5, 1988, shows an emergency control attachment for a trolling motor wherein the control mechanism is attached directly to the directional control shaft of the trolling motor.

However, none of the prior art devices propose a stick operated, remote cable steering mechanism which employs a steering block attached to the directional control shaft of a trolling motor.

None of the above inventions and patents, taken either singly or in combination, is seen to describe the instant invention as claimed.

SUMMARY OF THE INVENTION

The invention is an auxiliary steering device for a trolling motor, employing a mounting block attached to the directional shaft of the trolling motor, and connected via a continuous cable to a pivoting stick positioned on the gunwale of a boat. The stick, working in combination with the directional shaft, provides remote steering of an outboard trolling motor. Remote steering will enable the boat's operator to assume a more central seating location and thus, to observe the condition of the water and possible obstructions immediately in front of the bow of the boat. Such a remote steering arrangement also facilitates fishing and in particular, casting in all directions.

Accordingly, it is a principal object of the invention to provide a remote steering mechanism for a trolling motor which enables the operator to observe the condition of the water and to observe obstructions immediately in front of the bow of a boat.

It is another object of the invention to provide a remote steering mechanism for a trolling motor that allows the operator to be seated in a central location within the boat which facilitates casting and fishing in all directions.

It is a further object of the invention to provide remote steering mechanism which employs a steering block attached to the directional control shaft of a trolling motor.

Still another object of the invention is to provide complete control of the operations of a trolling motor at a remote steering location by removing the motor's speed control box from the top of the directional control shaft and positioning the speed control box in the boat proximate to the remote steering location.

For the purposes described, it is an object of the invention to provide improved elements and arrangements thereof which are inexpensive, dependable, and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
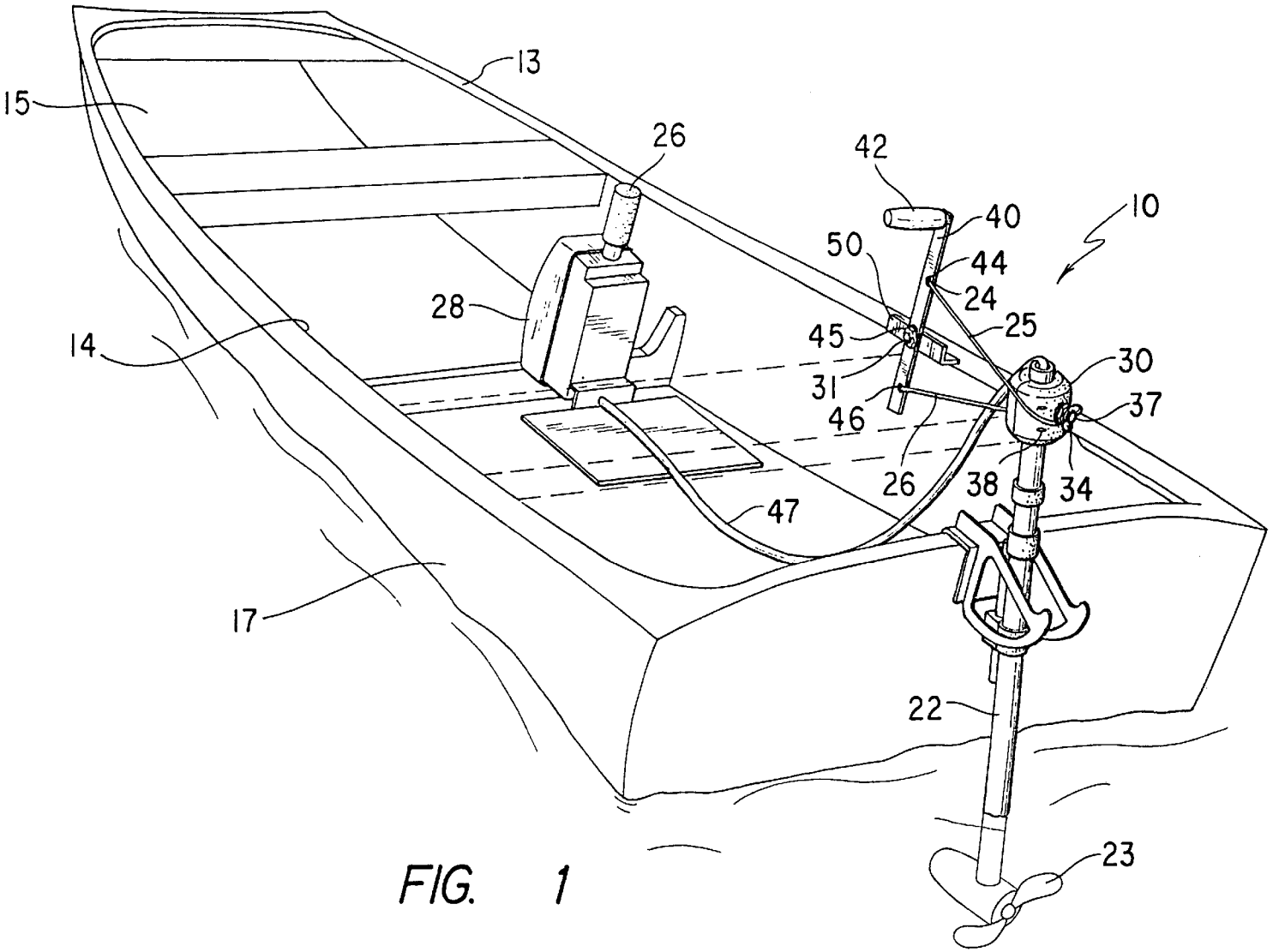
FIG. 1 is an environmental perspective view of the steering mechanism for a trolling motor according to the present invention.

Referring to the figures by numerals of reference and first to FIG. 1, a remote steering mechanism for a trolling motor generally designated by the reference numeral 10 will be described. Modification of an existing trolling motor for remote steering is accomplished by expanding the diameter of the directional shaft 22 of the trolling motor by the addition of a steering block 30.

Figure 2:
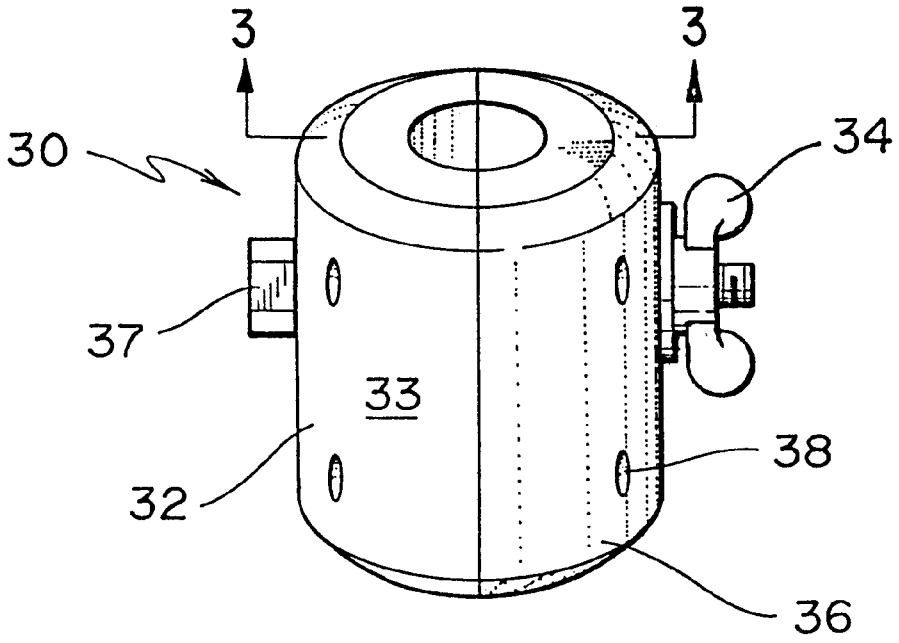
FIG. 2 is a perspective view of the steering block.
Figure 3:
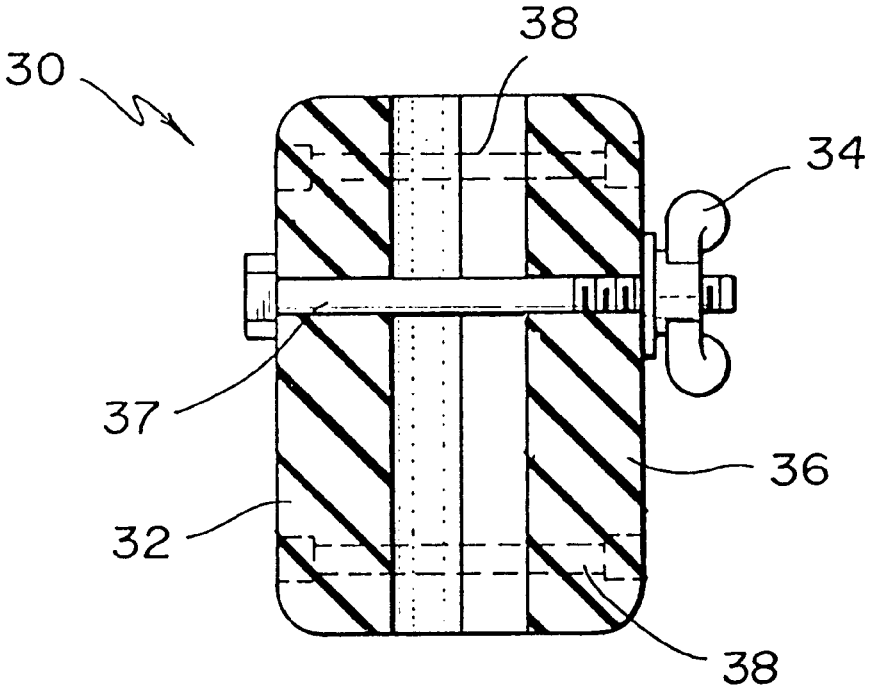
FIG. 3 is a cross sectional view of the steering block taken along lines 3—3 in FIG. 2.

As best illustrated in FIGS. 2 and 3, the steering block 30 is composed of two symmetric halves 32, 36. The symmetric halves are joined together by plurality of bolts 38. The head of each bolt 38 and the nut attached to the opposite end thereof are countersunk below the exterior surface 33 of the steering block 30 to eliminate any protuberances which might interfere with the steering mechanism.

Again referring to FIG. 1, an elongate cable 25, proximate to its midpoint, is wrapped around the steering block 30 and connected to a main bolt 37 which passes through the steering block 30 and directional shaft 22 of the trolling motor. Bolt 37 is held in place by a wingnut 34, the cable 25 being secured to the bolt by the wingnut 34, such as by wrapping the cable a turn about the bolt and tightening the wingnut firmly against the cable. An elongated control stick

40, having a handle 42 attached to one end, is pivotally attached to a mounting member 50 by a pivot bolt 31. One end 24 of the cable 25 is attached to an upper hole 44 within control stick 40. A second end 26 of the cable 25 is attached to a lower hole 46 within the control stick 40. Holes 44, 46 are respectively positioned at points above and below a pivot point 45 of the stick 40 and equidistant therefrom.

As a result of this configuration, the steering block 30 and thereby the directional shaft 22 of the trolling motor are connected by cable 25 to control stick 40 so that, when the control stick is moved toward the bow, the propeller 23 of the trolling motor turns to port, and, when the stick 40 is moved aft, the propeller 23 turns to starboard. The mounting member 50 may be attached to either the port gunwale 13 or starboard gunwale 14 of a boat 17, and using the appropriate length of cable 25, remote steering of the trolling motor can be accomplished in a variety of locations around the boat 17. The device is equally effective when used to establish remote steering of a bow mounted trolling motor. In all applications and because of its simplicity, the remote steering device 10 requires no modification when placed on the port gunwale 13 or starboard gunwale 14 and is therefore equally useful for right-handed and left-handed users.

To provide complete control of the trolling motor at the remote steering location, motor control box 28 and attached tiller 26 may be removed from the top of control shaft 22 and positioned at a site in the boat conveniently adjacent the remote steering location as illustrated in FIG. 1. This would enable the user to also control the speed of propeller 23 from the remote steering location. Extension wiring 47 is provided for connecting the propeller 23 and the removed motor control box 28.

It is to be understood that the present invention is not limited to the sole embodiment described above, but encompasses any and all embodiments within the scope of the following claims.

I claim:

1. A boat having a trolling motor supported thereon, said trolling motor provided with a directional shaft mounted to said boat;

a propeller positioned on a first end of said directional shaft;

a motor control box connected to and adapted to control the speed of said propeller; and a remote steering device for said trolling motor, said remote steering device comprising:

a cylindrical steering block, said block comprising two symmetric halves;

a plurality of bolts joining said symmetric halves to said directional shaft such that said steering block surrounds and is rigidly attached to said directional shaft;

an elongated control stick having an upper end and a lower end, said control stick has an upper hole disposed through said upper end and a lower hole disposed through said lower end;

pivoting means for pivotally mounting said elongated control stick on a gunwale of said boat at a position remote from said directional shaft;

wherein said control stick is attached to said pivot means at a pivot point on said control stick which is equidistant from said lower end and said upper end, wherein said upper hole and said lower hole are spaced an equal distance from said pivoting point; and a cable having a first end and a second end connecting said steering block to said control stick to provide remote steering of said trolling motor, wherein said cable is connected to said steering block with a wing nut;

wherein said first end of said cable is attached to said upper hole of said control stick and said second end of said cable is attached to said lower hole of said control stick.

2. The invention as defined in claim 1 wherein said control stick has a handle attached to said upper end.

3. The invention as defined in claim 2 wherein said motor control box is disposed at a position in said boat proximate said steering stick.

4. The invention as defined in claim 3 wherein extension wiring connects said motor control box with said propeller.

5. A trolling motor steering device for use with a trolling motor with a directional shaft, the steering device comprising;

a cylindrical steering block, said block comprising two symmetric halves having a central passage;

a plurality of bolts for joining said symmetric halves to said directional shaft such that said steering block surrounds and is rigidly attached to said directional shaft;

an elongated control stick having an upper end and a lower end defining a pivot point on said control stick which is between said lower end and said upper end, said control stick has an upper hole disposed through said upper end and a lower hole disposed through said lower end, said upper hole and said lower hole are spaced an equal distance from said pivot point;

means for pivotally mounting said elongated control stick on a gunwale of said boat at a position remote from said directional shaft; and a cable connecting said steering block to said control stick, wherein said cable has a first end attached to said upper hole and a second end attached to said lower hole and said cable is connected to said steering block with a wing nut.

6. The invention as defined in claim 5 wherein a handle is attached to said upper end.

* * * * *